US009228435B2

(12) United States Patent
VanBuren

(10) Patent No.: US 9,228,435 B2
(45) Date of Patent: Jan. 5, 2016

(54) METHOD AND APPARATUS FOR APPLYING ROCK DUST TO A MINE WALL

(71) Applicant: Rusmar Incorporated, West Chester, PA (US)

(72) Inventor: Ricky VanBuren, LaPlata, NM (US)

(73) Assignee: Rusmar Incorporated, West Chester, PA (US)

( * ) Notice: Subject to any disclaimer, the term of this patent is extended or adjusted under 35 U.S.C. 154(b) by 233 days.

(21) Appl. No.: 14/062,148

(22) Filed: Oct. 24, 2013

(65) Prior Publication Data

US 2015/0114671 A1 Apr. 30, 2015

(51) Int. Cl.

| | |
|---|---|
| ***E21F 5/08*** | (2006.01) |
| ***E21F 5/10*** | (2006.01) |
| ***E21F 5/12*** | (2006.01) |
| ***E21F 5/14*** | (2006.01) |
| ***E21F 5/16*** | (2006.01) |
| ***E21F 5/18*** | (2006.01) |
| ***E21F 5/20*** | (2006.01) |

(52) U.S. Cl.

CPC ..... *E21F 5/10* (2013.01)

(58) Field of Classification Search

CPC ..... E21F 5/08; E21F 5/10; E21F 5/12; E21F 5/14; E21F 5/16; E21F 5/18; E21F 5/20; A62C 99/0045

USPC ..... 169/44, 64; 299/12, 13; 239/654

See application file for complete search history.

(56) References Cited

U.S. PATENT DOCUMENTS

| | | | | |
|---|---|---|---|---|
| 1,954,154 | A | 4/1934 | Urquhart | |
| 2,146,605 | A | 2/1939 | Timpson | |
| 2,361,980 | A | 11/1944 | Tirrell | |
| 4,155,508 | A | 5/1979 | Fiorentini | |
| 4,394,975 | A | 7/1983 | Bare, Jr. et al. | |
| 4,538,941 | A | 9/1985 | Thorne | |
| 4,805,702 | A | 2/1989 | White | |
| 4,874,641 | A | 10/1989 | Kittle | |
| 5,096,616 | A | 3/1992 | Kittle | |
| 5,143,645 | A | 9/1992 | Roe | |
| 5,167,285 | A | 12/1992 | Williams et al. | |
| 5,215,786 | A | 6/1993 | Kittle | |
| 5,232,279 | A | 8/1993 | Boberg | |
| 5,368,105 | A * | 11/1994 | Chaiken | A62C 3/02 169/44 |
| 6,135,368 | A * | 10/2000 | Protan | A21F 5/10 239/143 |
| 6,431,465 | B1 * | 8/2002 | Yie | A62C 5/008 169/33 |
| 6,726,489 | B2 * | 4/2004 | Kappel et al. | 439/66 |
| 6,726,849 | B2 * | 4/2004 | Gay | A62D 1/0014 252/88.1 |
| 6,929,423 | B2 | 8/2005 | Kittle | |
| 6,994,491 | B2 | 2/2006 | Kittle | |

(Continued)

OTHER PUBLICATIONS

U.S. Appl. No. 14/062,175, filed Oct. 24, 2013, Titled: Process for Applying Rock Dust to a Mine Wall.

(Continued)

*Primary Examiner* — Arthur O Hall
*Assistant Examiner* — Joseph A Greenlund
(74) *Attorney, Agent, or Firm* — Howson & Howson LLP

(57) ABSTRACT

Rock dust is applied to a mine wall for mine fire suppression in combination with a chemical foam, by generating the foam from air and a foamable liquid in a mixing chamber, and delivering the foam through one flexible conduit and a suspension of rock dust in water through another flexible conduit to a combiner, and causing the combined foam, rock dust and water to pass through a flexible hose to a delivery nozzle from which it is applied to a mine wall.

5 Claims, 1 Drawing Sheet

(56) References Cited

U.S. PATENT DOCUMENTS

| | | | | |
|---|---|---|---|---|
| 7,530,404 | B2 * | 5/2009 | Lenz, Jr. | A62C 5/02 169/24 |
| 8,003,001 | B1 * | 8/2011 | Kaiser | A62C 3/00 169/44 |
| 8,584,974 | B2 * | 11/2013 | Masloff | A21F 5/10 239/126 |
| 8,613,401 | B2 * | 12/2013 | Fornaci | A21F 5/10 169/64 |
| 8,622,144 | B2 * | 1/2014 | Davis | A62C 5/02 169/14 |
| 8,883,868 | B2 * | 11/2014 | Masloff | C08J 9/30 169/46 |
| 2003/0146410 | A1 | 8/2003 | Gay et al. | |
| 2010/0186971 | A1 * | 7/2010 | Seyffert | A62C 31/22 169/13 |
| 2011/0203813 | A1 | 8/2011 | Fenton et al. | |
| 2012/0111583 | A1 | 5/2012 | Brown et al. | |
| 2012/0205129 | A1 * | 8/2012 | Hussey | 169/44 |
| 2012/0256020 | A1 | 10/2012 | Masloff et al. | |
| 2013/0277072 | A1 * | 10/2013 | VanBuren | A62C 3/02 169/44 |
| 2014/0265523 | A1 * | 9/2014 | Wright | E21F 5/12 299/12 |

OTHER PUBLICATIONS

Description of foam concrete, http:/www.foamedconcrete.co.uk/forsale 1.php, Pro Pump Engineering LTD UK.

* cited by examiner

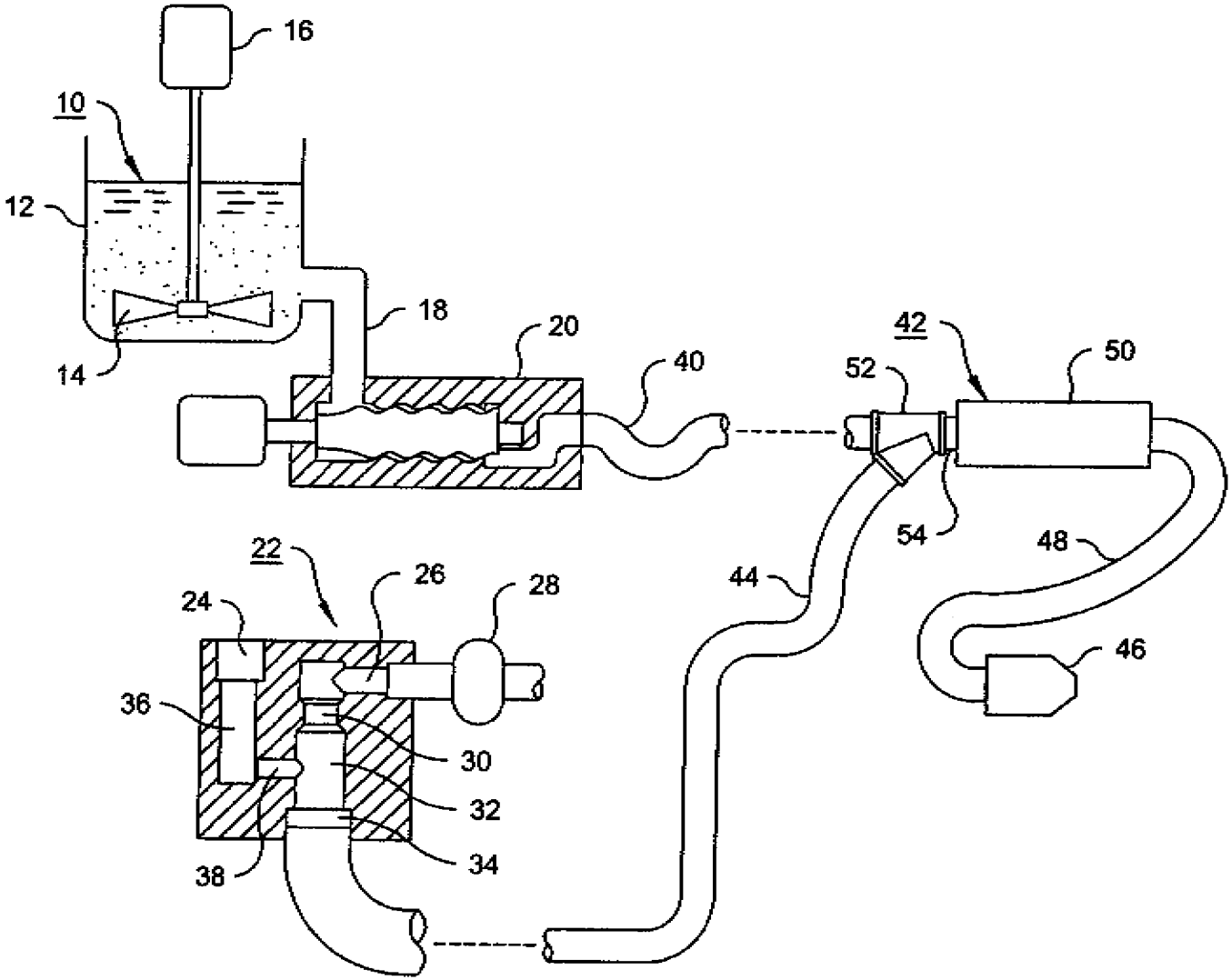
10
12
14
16
18
20
22
24
26
28
30
32
34
36
38
40
42
44
46
48
50
52
54

METHOD AND APPARATUS FOR APPLYING ROCK DUST TO A MINE WALL

FIELD OF THE INVENTION

This invention relates generally to coal mining, and more particularly to the application of rock dust to a mine wall for the purpose of suppressing mine fires and preventing explosions.

BACKGROUND OF THE INVENTION

In coal mining, it has been common practice to apply limestone in the form of a dust to the walls of a mine, thereby causing the limestone to adhere to the walls. The process, known as "rock dusting," has two effects. First, because the limestone dust covers exposed surfaces of unmined coal, it prevents mine fires from being propagated along those exposed surfaces. Second, if methane, coal dust, or a mixture of methane and coal dust, ignite in a mine causing an explosion, the rock dust adhering to the mine wall will become airborne, and suppress the propagation of fire resulting from the explosion.

The United States Mine Safety and Health Administration has established standards for rock dusting, which include a requirement that all exposed surfaces of a mine be covered with rock dust at least 80% of the content of which is non-combustible. Existing methods for applying rock dust include application of rock dust to a mine wall. Recently, mines have begun using chemical foam to achieve improved adhesion of the rock dust to mine surfaces. One method of using foam in rock dust application is to apply a dry mixture of rock dust and a foaming agent to a mine wall. Another method is to apply a mixture of foam and rock dust to a mine wall. In the last-mentioned method, the foam is formed, mixed with rock dust in a mixing vessel, and pumped through a conduit to the point of application. A system for utilizing foam to enhance the adhesion of rock dust to a mine wall is described in U.S. Pat. No. 6,726,849, granted Apr. 27, 2004. Still another method, described in United Stated Patent Publication 2012/0181051, published Jul. 19, 2012, utilizes a composition made up of rock dust, water, a pumping aid and a polymer is applied to a mine wall. The pumping aid can be a foaming agent such as a laurel ether sulfate. A foamed slurry composition is prepared by mixing rock dust and water in a tank, using a paddle mixer in the bottom of the tank for agitation. The pumping aid is added to the slurry, and a foamed slurry is formed by further agitation by the paddle mixer. The foamed slurry is then pumped to a nozzle for spraying.

In known systems in which a foam is combined with rock dust upstream of a delivery pump, or in which a mixture including rock dust and a foaming agent is caused to foam upstream of the pump, several problems can arise. The expansibility of the gas component of the foam can either interfere with the operation of the pump or limit the proportions of ingredients in the foamed compositions to ranges that allow the composition to be pumped effectively. In addition, the action of the pump can cause deterioration of the foam, requiring the generation of large amounts of foam, or the use of large amounts of foaming agent, to provide adequate quantities of foam in the mixture being applied to the mine wall.

In still another method, described in my copending U.S. patent application Ser. No. 13/736,112, filed Jan. 8, 2013, an apparatus for applying rock dust to a mine wall comprises first and second conduits. Rock dust is entrained in air in the first conduit, and a flowable foam, made by mixing a foamable liquid and air, is delivered through the second conduit. Rock dust and air taken from the first conduit are combined with flowable foam taken from the second conduit, and the combined mixture of air, rock dust and foam is applied by a nozzle to a mine wall.

Among the apparatus and methods used previously for applying rock dust, the method described in U.S. patent application Ser. No. 13/736,112 has, among its advantages, the ability to combine rock dust and foam near the point of application to the mine wall, not only avoiding difficulties encountered in pumping a foamed mixture, but also avoiding the deterioration of foam that takes place when a foam travels through a long conduit along with rock dust. However, the air used to entrain the dust in the process of patent application Ser. No. 13/736,112 also causes the foam to deteriorate, even though the foam is combined with the air-entrained rock dust at the location of the nozzle.

SUMMARY OF THE INVENTION

This invention addresses the above-described problems of pumping a foam and foam deterioration by combining a foam with a slurry of rock dust and water in a combiner downstream of a pump that delivers the slurry. The foam can be combined with the slurry near the point of application to a mine wall. In addition, by eliminating the use of entraining air for transporting the rock dust from a supply thereof to the point of application, and instead utilizing a rock dust/water slurry and combining it with foam downstream of the slurry pump, deterioration of the foam can be significantly reduced, and a uniform mixture of foam, water and rock dust can be applied to the mine wall for more effective suppression of mine fires.

More particularly, the apparatus for applying rock dust to a mine wall in accordance with the invention comprises a vessel storing a mixture of rock dust and water, a pump, having an inlet in communication with the vessel receives the mixture and delivers the mixture through a first conduit. The apparatus also comprises a foam generator for mixing a foamable liquid and air to produce a flowable foam for delivery through a second conduit. A combiner is connected to the outlet ends of the first and second conduits. The combiner has an internal chamber arranged to receive the mixture of rock dust and water from the first conduit and the flowable foam from the second conduit. A mixture of foam, water and rock dust from the internal chamber of the combiner is carried, preferably through a third conduit to a delivery nozzle for spraying the mixture of foam, water and rock dust onto a mine surface. The delivery nozzle can be made a part of the combiner, in which case the third conduit can be eliminated.

The first, second and third conduits can be elongated, flexible conduits. Because the foam is not combined with the mixture of water and rock dust until it reaches the combiner, the first and second conduits can be provided in any suitable lengths without serious detrimental effect on the quality of the foam/rock dust mixture applied to the mine wall. Thus, the first conduit, i.e., the conduit that carries the rock dust and water slurry, the second conduit, i.e., the foam conduit, or both, can be longer than the third conduit, allowing application of the foam/rock dust mixture to a large area of a mine wall without moving components such as the rock dust/water storage vessel, the pump and the foam generator. The length of the third conduit can be less than the length of either or both of the first and second conduits. Preferably the length of the third conduit is less than 15 meters in order to minimize deterioration of the foamed mixture to be applied to the mine wall.

Another aspect of the invention is a method of applying rock dust to a mine wall. The method comprises pumping a mixture of rock dust and water through a first conduit to a combiner, mixing a foamable liquid and air to produce a flowable foam, and delivering the flowable foam through a second conduit to the combiner. The mixture of rock dust and water, and the flowable foam, are mixed in the combiner to produce a mixture of foam, water and rock dust, which is then applied to a mine wall by means of a nozzle connected to the combiner.

BRIEF DESCRIPTION OF THE DRAWINGS

FIG. 1 is a schematic diagram of a mine dusting apparatus in accordance with the invention;

DETAILED DESCRIPTION OF THE PREFERRED EMBODIMENTS

In the apparatus shown in FIG. 1, a mixture 10 of rock dust and water is stored in a vessel 12 and the mixture is agitated by mixer blades 14, rotated by a motor 16, to keep the rock dust in suspension, forming a slurry that can be drawn from the vessel 12 through outlet pipe 18.

The outlet pipe is connected to an inlet port of a pump 20, which can be any of several types of pumps suitable for pumping a slurry of rock dust in water, such as a progressive cavity pump or a peristaltic pump. The pump illustrated in FIG. 1 is a progressive cavity pump of the kind described in U.S. Pat. No. 7,553,139, granted Jun. 30, 2009.

A mixing block 22 comprises a metal block having internal passages. Compressed air, delivered through a check valve (not shown), enters the block though an opening 24, and diluted foam concentrate, in the form of a liquid, is pumped into the block through opening 26 by a high pressure liquid pump 28. The diluted foam concentrate flows through restriction 30 into a mixing chamber 32 having an outlet 34. Compressed air flows through passage 36 and into the mixing chamber 32 through a restricted passage 38, which meets the side of mixing chamber 32 so that the flow of compressed air into mixing chamber 32 is perpendicular to the direction of flow of the liquid foam concentrate. Turbulence in the mixing chamber produces the foam that is delivered through outlet 34. The mixing block regulates the flow of diluted foam concentrate and compressed air to maintain proper proportions.

The outlet of pump 20 is connected through a first conduit 40 to a combiner 42, and outlet 34 of mixing block 22 is connected to combiner 42 through a second conduit 44. A third conduit 48 leads from the combiner 42 to a nozzle 46, from which a mixture of rock dust, water and foam can be sprayed onto a mine surface. As mentioned above, the third conduit can be eliminated if the nozzle is made a part of the combiner.

In a preferred mine dusting apparatus in accordance with this invention, all three conduits are in the form of flexible hoses. The flexibility of the hoses allows the nozzle to be moved about easily over a large distance within the mine, while allowing the combiner 42, which is preferably portable, to be in close proximity to the nozzle.

In a typical dusting apparatus, the first conduit 40 can be, for example, a hose having a one inch (approximately 2.5 cm) internal diameter, and a length of 80 feet (approximately 25 meters). The second conduit 44 can have an internal diameter of one inch (approximately 2.5 cm) and a length of 100 feet (approximately 30 meters. The third hose can also have an internal diameter of one inch (approx. 2.5 cm), but can be much shorter than the first and second conduits, e.g., 20 feet (approximately 6 meters).

As indicated previously, the use of a slurry composed of rock dust and water instead of air-entrained rock dust, the combination of the foam with the rock dust/water slurry downstream of the slurry pump, and close proximity of the combiner to the nozzle, aid in preventing deterioration of the foam. The length of the third conduit 48 can be greater or less than the length of the first conduit 40 and also either greater or less than the length of the second conduit 44. Irrespective of the lengths of the first and second conduits, the third conduit 48 should be not more than 15 meters in length.

The combiner 42, which can also be referred to as a "static mixer," comprises a short length of conduit 50, e.g. a hose, having an internal diameter, e.g. 2 inches (approximately 5 cm), greater than that the internal diameters of the first and second conduits. The length of the conduit 50 can be, for example, about 2 feet (approximately 0.6 meters).

A Y-connector 52 is provided at the inlet end 54 of conduit 50, with one branch, preferably a branch axially aligned with conduit 50, connected to the slurry-carrying conduit 40, and the other branch, which can be an oblique branch, connected to the foam-carrying conduit 44.

Because the diameter of the conduit 50 is larger than that of conduits 40 and 44, a pressure drop occurs in the fluids as they pass through conduit 50 resulting in turbulence, causing mixing of the rock dust/water slurry with the foam and thereby producing a foam-like material sufficiently homogeneous to ensure adequate and uniform adhesion to a mine wall or other mine surface.

Other mixing devices can be used in place of the simple hose and Y-connector combination described. For example a static mixer in the form of a conduit having fixed internal baffles or blades to enhance mixing can be utilized. Alternatively, mixers having moving blades or similar moving agitators can be used.

All or parts of the hose 48 and of the hoses 40 and 44 can be flexible, allowing an operator to move the combiner readily and to aim the nozzle 46 for application of a foam and rock dust mixture to a mine surface.

The foamable liquid delivered to the mixing block 22 through pump 28 can be prepared by dilution of a foam concentrate with water. A suitable foam concentrate is the foam concentrate, composed of an anionic surfactant and a carboxylic acid salt, described in U.S. Pat. No. 4,874,641, granted Oct. 17, 1989, the disclosure of which is here incorporated by reference. The foam exhibits a high degree of stiffness and longevity, making it especially suitable for application, along with rock dust to a mine surface. Optionally, a quantity of a thickener such as hydroxypropylmethylcellulose to the foam concentrate can be added to increase foam stability and increase foam volume.

An example of a suitable foam concentrate described in U.S. Pat. No. 4,874,641 is one composed of 4% by weight sodium α-olefin sulfonate (100% active basis), 3.6% by weight stearic acid (100% active basis), 0.71% by weight potassium hydroxide, and 91.59% by weight, water. Any of the compositions described in U.S. Pat. No. 4,874,641, as well as many other known foaming compositions, can be used. The foam concentrate can be diluted with water to a ratio as high as approximately 10:1.

Another foam concentrate that can be used is one composed of 4% by weight sodium α-olefin sulfonate (100% active basis), 5% by weight stearic acid (100% active basis), 0.71% by weight potassium hydroxide, and 90.29% by weight, water. This concentrate can be utilized effectively at dilution ratios up to about 10:1. A dilution ratio (water to concentrate) of approximately 7:1 is considered optimum. At a dilution ratio of 7:1, the stearic acid content in the diluted foamable liquid is 0.5%. At a dilution ratio of 10:1, the stearic acid content in the diluted foamable liquid is 0.45%. Significantly lower dilution ratios can be used, but reducing the dilution ratio below 7:1 has little if any beneficial effect, and can increase operating costs unnecessarily.

As mentioned above, the function of the mixing block is to maintain proper proportions of the diluted foam concentrate and compressed air. In the case of a diluted foam concentrate having the composition described above, a desirable proportion is from 2.75 to 3 cubic feet of compressed air (at approximately 100 psi) for each gallon of liquid. The apertures of the restrictions in the mixing block are chosen accordingly. The sizes of the apertures, of course, also affect the rate of foam delivery.

An advantage of the invention over prior methods and apparatus for rock dust application is that it avoids pumping problems and limitations, and minimizes foam deterioration, by combining the foam with the rock dust/water slurry downstream of the pump. Another advantage is that it not only combines the rock dust and foam at a location near the point of application, but also avoids deterioration of the foam that can result from the use of air to entrain the rock dust. This invention, while affording benefits similar to those afforded by the system described in U.S. patent application Ser. No. 13/736,112, has the advantage that it avoids airborne rock dust. The apparatus and method described herein are capable of producing a uniform mixture of rock dust and foam, and applying a coating of rock dust to a mine wall with sufficient uniformity to perform reliably when needed for the suppression of mine fires.

Various modifications can be made to the apparatus described. For example, the configuration of the foam generating block can be altered, types of pumps other than progressive cavity pumps and peristaltic pumps can be utilized to deliver the rock dust/water mixture to the combiner, and other forms of combiners can be utilized, including combiners having moving blades or agitators. These and other modifications can be made without departing from the scope of the invention, which is defined by the following claims.

What is claimed is:

1. A method of applying rock dust to a mine wall comprising:

pumping a mixture of rock dust and water by means of a pump, from said pump through a first conduit, to a combiner;

mixing a foamable liquid and air to produce a flowable foam, and delivering the flowable foam through a second conduit to said combiner;

combining said mixture of rock dust and water with said flowable foam in said combiner, to produce a mixture of foam, water and rock dust;

causing said mixture of foam, water and rock dust to flow from said combiner to a nozzle connected to said combiner; and while combining rock dust and water with foam in said combiner, applying said mixture of foam, water, and rock dust to a mine wall by means of said nozzle, wherein the distance through which said mixture of rock dust, water, and foam flows from said combiner to said nozzle is less then 15 meters, and the distance through which said mixture of rock dust and water flows from said pump through said first conduit to said combiner is greater than said distance through which said mixture of rock dust, water, and foam flows from said combiner to said nozzle.

2. The method of claim 1, wherein said nozzle is connected to said combiner by a third conduit, said third conduit being a flexible conduit.

3. The method of claim 1, wherein said nozzle is connected to said combiner by a third conduit, and wherein said first, second and third conduits are elongated, flexible conduits.

4. The method of claim 1, wherein said nozzle is connected to said combiner by a third conduit, and wherein the length of said third conduit is less than the length of said second conduit.

5. The apparatus of claim 1 including agitating said mixture of rock dust and water before pumping said mixture through said first conduit to said combiner, thereby maintaining said rock dust in suspension in said water.

* * * * *